United States Patent [19]

Chen

[11] Patent Number: 4,751,499

[45] Date of Patent: Jun. 14, 1988

[54] CORDLESS REMOTE CONTROLLED BURGLAR PROOF DEVICE

[76] Inventor: Gin-Tzang Chen, 7-4 Fl., No. 186, Sec. 4, Nan Ching E. Road, Taipei, Taiwan

[21] Appl. No.: 824,266

[22] Filed: Jan. 30, 1986

[51] Int. Cl.[4] ..... G08B 13/08

[52] U.S. Cl. ..... 340/547

[58] Field of Search ..... 340/547

[56] References Cited

U.S. PATENT DOCUMENTS

| | | | |
|---|---|---|---|
| 3,769,556 | 10/1973 | Feldman | 340/547 X |
| 3,986,183 | 10/1976 | Fujiwara | 340/547 X |
| 4,160,972 | 7/1979 | LaMell et al. | 340/547 X |
| 4,209,777 | 6/1980 | Morrison | 340/547 |
| 4,232,309 | 11/1980 | Dillitzer | 340/547 |
| 4,292,629 | 9/1981 | Kerr et al. | 340/547 |
| 4,438,430 | 3/1984 | Young et al. | 340/547 |

FOREIGN PATENT DOCUMENTS 634331 11/1978 U.S.S.R. ..... 340/547

*Primary Examiner*—Stewart J. Levy
*Assistant Examiner*—Joseph W. Roskos
*Attorney, Agent, or Firm*—Lowe, Price, LeBlanc, Becker & Shur

[57] ABSTRACT

A cordless remote controlled burglar proof device including a transmitter and a receiver, wherein the transmitter is controlled by a reed switch corresponding to a magnet. The reed switch and magnet are installed at door/window wing and frame respectively. When the reed switch senses the magnetic field of the magnet, then the circuit remains passive. As soon as the door/-window is opened, the reed switch is no longer activated by the magnet, the transmitter is triggered to transmit an ultra high frequency electromagnetic signal to trigger lighting device or alarm upon receipt of the signal by the receiver.

1 Claim, 1 Drawing Sheet

CORDLESS REMOTE CONTROLLED BURGLAR PROOF DEVICE

BACKGROUND OF THE INVENTION

The present invention provides a cordless remote controlled burglar proof device, particularly one with a transmitter to trigger an alarm. The transmitter has a reed switch and a magnet to be installed at door/window frame and door/window wing respectively. Movement of the magnet from the reed switch can trigger the transmitter, alarm will be given or lighting device will be turned on as soon as the receiver receives signal from the transmitter for the purpose of burglar proofing or sounding an alarm.

Generally, ordinary burglar proof device installed at doors or windows can detect displacement of door or window and sound an alarm accordingly. The triggering element is usually a microswitch which has its contact at different positions with the movement of the door/window wing, and an alarm is connected to one of such positions. In other words, a microswitch is used to trigger alarm circuit. However, the conventional burglar alarm devices still have the following defects:

(1) The microswitch is a mechanical element. It will lose its efficiency or have a delay action after prolonged use.

(2) It is a very hard to conceal the wire between a microswitch and an alarm. Furthermore, wiring always distracts from the esthetic qualities of indoor furnishing.

SUMMARY OF THE INVENTION

The main object of the present invention is to provide a cordless remote controlled burglar proof device which use a transmitter to detect any unauthorized displacement of the door/window wing and a receiver to trigger lighting device or alarm upon receipt of signal from the transmitter. The transmitter has a reed switch and a corresponding magnet. When the door/window is closed, the reed switch is activated by the magnet and turn off the transmitter, but when the door/window is opened, the reed switch is no longer activated by the magnet and the transmitter is turned on to transmit an electromagnetic wave to the receiver ao as to trigger a lighting device or an alarm.

Further objectives and advantages of the present invention will become apparent as the following description proceeds, and the features of novelty which characterize the invention be point out with particularity in the claims annexed to and forming a part of this invention.

Figure 1:
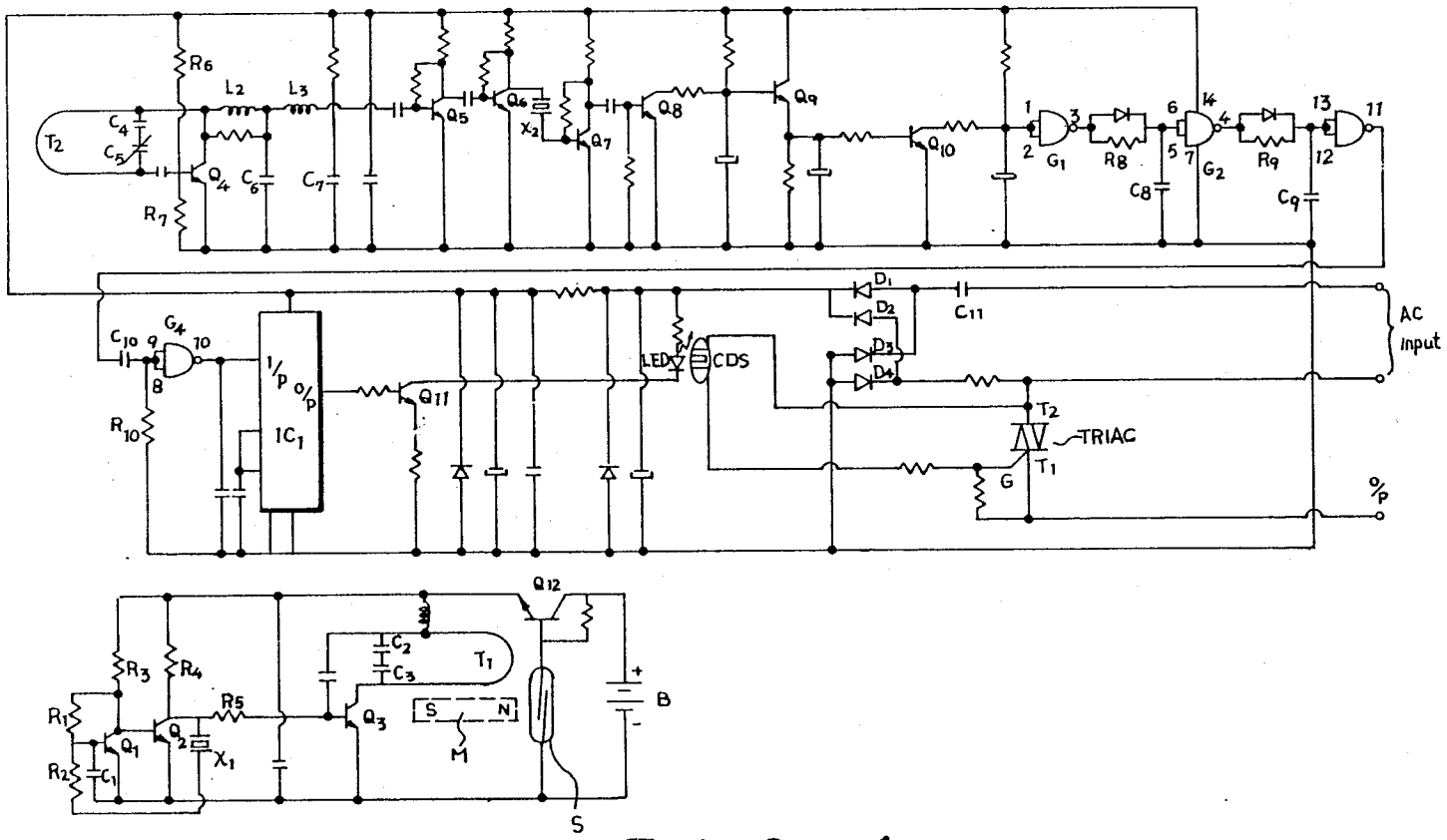
FIG. 1 is a circuit diagram for the present invention.

(Q1)-(Q12) Transistors
(R1)-(R10) Resistors
(C1)-(C11) Capacitors
(X1)-(X2) Quartz Oscillators
(L1)-(L3) Inductances
(T1)-(T2) Antennas
(G1)-(G4) Hand Gates
(IC1) Divider
(LED) Light Emitting Diode
(CDS) Photo Resistor
(TRIAC) Triode AC Switch
(D1)-(D4) Diodes
(S) Reed Switch (B) Battery
(M) Magnet

DETAILED DESCRIPTION OF THE INVENTION

FIG. 1 shows a circuit diagram of the present invention. As shown in the figure, the upper part illustrates a receiver and the lower part illustrates a transmitter. The transmitter comprises a quartz oscillation circuit which is formed of two transistor (Q1) and (Q2), bias resistors (R1)-(R4), a capacitor (C1) and quartz oscillator (X1) to provide a stable sinusiodal signal. A transistor (Q3) and its inductor (L1) as well as capacitors (C2) and (C3) form a transmitter circuit to transmit carrier signal from an antenna connecting to the collector of the transistor (Q3). The transmitter circuit comprises a battery (B) as a built-in power source. The positive pole of the battery is connected to the collector of a switching transistor (Q12) while the collector is connected to the above circuit. A resistor is connected between the base and collector of the switching transistor (Q12), and a reed switch (S) is connected between the base and the negative pole of the battery so that the reed switch will be in a closed circuit by attraction of a magnet (M) corresponding to the reed switch (S), and thus the base of the transistor (Q12) will be cut off and power supply to the transmitter will be cut off too. When the magnet (M) has moved for a certain distance, the reed switch (S) is no longer activated by the magnetic force so as to make the reed switch (S) open. In the meantime, the base of the switching transistor (Q12) turns to high potential and conducts to provide the transmitter with an adequate electric energy so that the transmitter functions normally, and wave transmitted from the transmitter can be received by a receiver to trigger a lighting device or an alarm.

Therefore,the above mentioned transmitter primarily uses the reed switch (S) to open and close the circuit, to operate and turn off the transmitter. In other words, a magnet (M) is used to turn on or off the transmitter with magnetic force.

The upper part of FIG. 1 shows a receiver according to the present invention. It comprises a transistor (Q4), an antenna (T2), resistor (R6) and (R7), and capacitors (C4) and (C5) which form a high frequency amplifier circuit to pick up external electromagnetic waves. After high frequency filtering at the inductor (L2) and (L3), and at capacitors (C6) and (C7), the electromagnetic waves are adequately amplified at the intermediate amplifier composed of two transistors (Q5) and (Q6). The collector of the transistor (Q6) is connected to a quartz oscillator (X2) in series to form a quartz filter to filter off high frequency noice. Then the filtered wave is input to NAND gates (G1), (G2), (G3) and (G4) and two integrator circuits and a differential circuit. Transistors (Q7), (Q8), (Q9) and (Q10) provide lower frequency amplification for the signal and raise its potential level to generate a pure square wave low frequency pulse. Then, the pure square wave low frequency pulse output is connected to a divider (IC1) to lower its frequency so as to drive the transistor (Q11) from its output pin (O/P). A light emitting diode (LED) is connected in series between the collector of the transistor (Q11) and the positive pole of the battery which can convert the high signal to light. A photo-resistor (CDS) is connected to a side of the light-emitting diode (LED), both ends of the photo-resistor (CDS) are connected across the positive pole (T2) and gate (G) of a triode AC switch (TRIAC). A contactless switch is connected between the positive pole (T1) of the triode AC switch (TRIAC). A lighting device or an alarm may be connected to the negative pole (T1) in series before connecting to the external AC power source. As for the power supply to the receiver circuit, city power input is rectified to direct current at a bridge rectifier composed of four diode (D1)-(D4), and has its voltage reduced properly by resistor and voltage stabilizing diode before application.

In application, the transmitter may be fixed to the wing of a door or a window, and the corresponding magnet at the frame of the door or window. When the door or window is closed, the reed switch in the transmitter and the magnet act with each other to prevent the transmitter from operation. As soon as the door or window is opened, the magnet accordingly moves away from the transmitter, the reed switch operates to energize the transmitter to emit carrier signals. Upon receipt of such signal, the receiver amplifies the signal and processes it an NAND gates (G1)-(G4), divider (IC1) so that the triode AC switch (TRIAC) turns on the lighting device or alarm connected externally for the purpose of remote controlled burglar proof and alarming.

As various possible embodiments might be made of the above invention without departing from the scope of the invention, it is to be understood that all matter herein described as illustrative and not in a limiting sense. Thus it will be appreciated that the drawings are exemplary of a preferred embodiment of the invention.

I claim:

1. A cordless remote controlled burglar proof device comprising:

a reed switch installed on a door or window;

a magnet installed on a corresponding door or window which responds to said reed switch for sensing and controlling a transmitter to sound an alarm or the like;

a transmitter circuit comprising a quartz oscillation circuit, a transistor, an amplification transistor, and an antenna wherein the collector of said transistor connects to said read switch and if said reed switch is not activated by said magnet, then said transistor transmits a signal to said quartz oscillation circuit of said transmitter circuit; said signal being amplified by said amplification transistor and being emitted through an antenna to a receiving circuit;

said receiving circuit receiving and transmitted signal from said transmitter circuit by a receiving antenna and transforming said signal by means of high-frequency amplification, quartz filtering, low-frequency amplification and four NAND gates to trigger a triode AC switch so that said triode AC switch activates an external lighting device or alarm for remote controlled burglar proofing for sounding an alarm;

said reed switch being activated by said magnet when the door or window is closed so that said transmitter is cut off and does not transmit any signal; once the door or window is opened, said transmitter transmitting a signal to said receiving circuit to trigger an alarm when said reed switch is no longer activated by said magnet.

* * * * *